US006238489B1

(12) United States Patent
Lundell

(10) Patent No.: US 6,238,489 B1
(45) Date of Patent: May 29, 2001

(54) METHODS AND APPARATUS FOR MASKING A PERCUSSIVE DRILL MEMBER PRIOR TO A SURFACE TREATMENT THEREOF

(75) Inventor: Lars-Gunnar Lundell, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/151,098

(22) Filed: Sep. 10, 1998

(30) Foreign Application Priority Data

Sep. 10, 1997 (SE) ..... 9703262

(51) Int. Cl.[7] ..... B23C 8/20
(52) U.S. Cl. ..... 148/212; 148/213
(58) Field of Search ..... 148/213, 212

(56) References Cited

U.S. PATENT DOCUMENTS 3,527,624 * 9/1970 Biretta et al. ..... 148/14
3,873,376 * 3/1975 Ritzka ..... 148/213 X
4,062,702 * 12/1977 Kunst et al. ..... 148/14
4,165,243 8/1979 Sarnes et al. .
4,664,722 * 5/1987 Clinkscales et al. ..... 148/213 X
4,867,015 9/1989 Kane et al. .

FOREIGN PATENT DOCUMENTS

27549 * 4/1898 (GB) ..... 148/213

* cited by examiner

*Primary Examiner*—M. Rachuba
(74) *Attorney, Agent, or Firm*—Burns, Doane, Swecker & Mathis, L.L.P.

(57) ABSTRACT

A metallic drilling member is surface hardened except at an end portion, because the end portion is masked. The masking is achieved by placing on the end portion a lid which forms a slight gap around the surface being heat treated. During the heat treatment a furnace atmosphere enters the gap to cause the depth of the heat treatment to be gradually decreased in a manner producing a relatively elongated transition zone between heat treated and non-heat treated portions of the surface. The gap can be of constant width, or gradually decreasing width.

5 Claims, 4 Drawing Sheets

METHODS AND APPARATUS FOR MASKING A PERCUSSIVE DRILL MEMBER PRIOR TO A SURFACE TREATMENT THEREOF

FIELD OF THE INVENTION

The present invention relates to methods and apparatus for masking a drill member, prior to a thermo chemical surface treatment thereof.

BACKGROUND OF THE INVENTION

During thermo chemical surface treatment such as carburizing, nitrocarburization, boriding, etc. it is sometimes required that certain surfaces shall maintain the same chemical composition as before the heat treatment. Normally, this happens by coating these surfaces with some preparation (i.e., masking the surfaces) which prevents the steel surface from being directly exposed to the furnace atmosphere. The coating forms a more or less diffusion sealed layer for elements in the furnace atmosphere which is not in equilibrium with steel. The coating can be done in a number of ways such as by brushing, dipping, spraying of fluid coating, sticking of pastes or by electrolytic copper coating.

During, for example, the carburizing of tubes, if one wishes that the ends and a portion about 20 mm along the tube length are not carburized, neither internally nor externally, a usual method is to dip the tube end in a coating material, referred to as paint, which then may dry under increased temperature to form a layer. For the layer to be dense, drops must not be formed, and the layer must not be too thin. Therefore often an adjustment must be done with a brush or with another tool after the dipping for smoothing the layer. The method is expensive since it requires large exactness both with regards to the paint (viscosity, composition etc.) and the application step.

Depicted in FIG. 7 is a drilling apparatus comprised of a drill member 1 and a cutting head 50 attached thereto. The drill member is surface treated except at an end portion where the cutting head is to be attached. The heat treatment is prevented there by a masking step. FIG. 1 shows an example of a hollow drill member or a tube 1, an end 2 of which has been masked with a protective coating in a conventional manner through dipping. The protective coating is applied at the end surface and along a part of the surface of the tube length and somewhat along the inside hole 1*a*. Arrows depict the motion of the furnace atmosphere on the surfaces. FIG. 2 shows characteristics of a carburized tube 1 whose end surface 2 had been painted with a protective coating before the carburizing.

The carburized layers 4 have a depth d usually of about 1 mm and a relatively abrupt transition 5 at the junction with the protected surface. The length a of that transition zone is often about 1 mm. The abruptness of the transition 5 can be calculated by dividing the transition zone length by the depth, i.e., a/d (the shorter the length a, the greater the abruptness). Thereby, the abruptness amounts to about 1 in the conventional method for heat treatment such as disclosed for example U.S. Pat. No. 4,165,243. The abruptness of the transition creates unfavorable states of strain in the surface for example if the tube or the rod is submitted to bending or impact stresses. A thermo chemical treatment of a down-the-hole drill bit is described in U.S. Pat. No. 4,867,015, wherein the insert holes in the drill bit are covered with print before the heat-treatment is started.

One object of the present invention is to provide a method for masking a member before a thermo chemical surface treatment in a simple and thereby cost-effective manner.

Another object of the present invention is to provide a method for masking a member prior to a thermo chemical surface treatment for improving the strength of the member.

Still another object of the present invention is to provide a drill member with successively varying heat treatment.

Still another object of the present invention is to provide a device which enables control of the heat treatment.

SUMMARY OF THE INVENTION

The objects and advantage of the invention are achieved by a method of masking a metallic percussive drill member prior to a thermo chemical surface treatment thereof. The drill member is of elongated shape and has a central channel formed therein. The method comprises the steps of:

A. positioning on an end portion of the drill member a lid such that an end wall of the lid abuts a free end of the drill member, and a side wall of the lid extends along a surface of the drill member with a gap formed therebetween;

B. heating the lid and the drill member to a heat-treating temperature in a furnace whereby a portion of the surface of the drill member not covered by the lid is heat treated to a depth, and whereby furnace atmosphere enters the gap and causes the heat treatment depth to be gradually reduced in a direction toward the end wall;

C. cooling the lid and the drill member; and

D. removing the lid from the drill member.

The present invention also relates to a drill member which has been hardened to a depth along a first portion thereof and non-hardened along a second portion thereof. The depth of hardening becomes gradually smaller at a junction between the first and second portions and defines a transition. The transition has a longitudinal length. A ratio of: (a) the length of the transition to (b) a depth of the hardening along the first portion, is greater than one.

The invention also pertains to a heat treatment lid for protecting a metal surface of a member from the effects of a thermo chemical treatment. The heat treatment lid comprises an end wall and at least one side wall extending from the end wall to form a recess opening in a direction opposite the end wall and adapted to receive the member.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
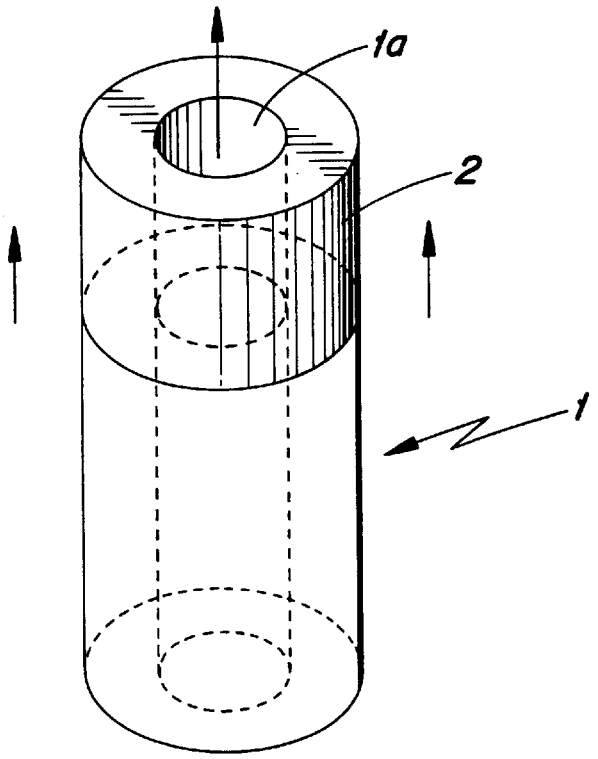
Fig. 1 (PRIOR ART)
FIG. 1 shows in a perspective view, a drill member covered with a protective coating produced in a conventional manner through dipping.
Figure 2:
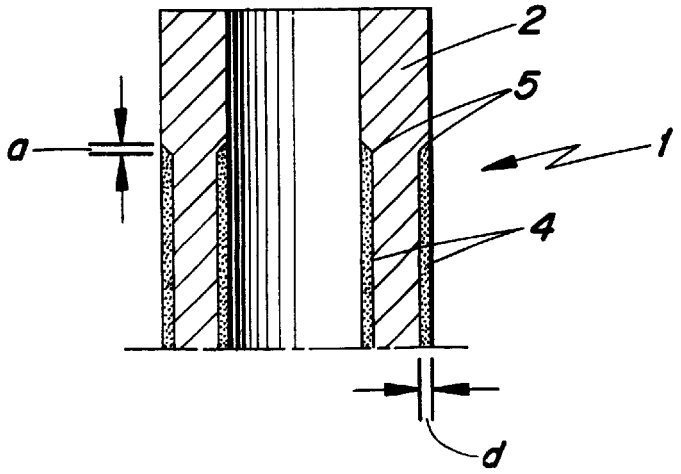
Fig. 2 (PRIOR ART)
FIG. 2 is a longitudinal sectional view through the heat-treated drill member of FIG. 1.
Figure 3:
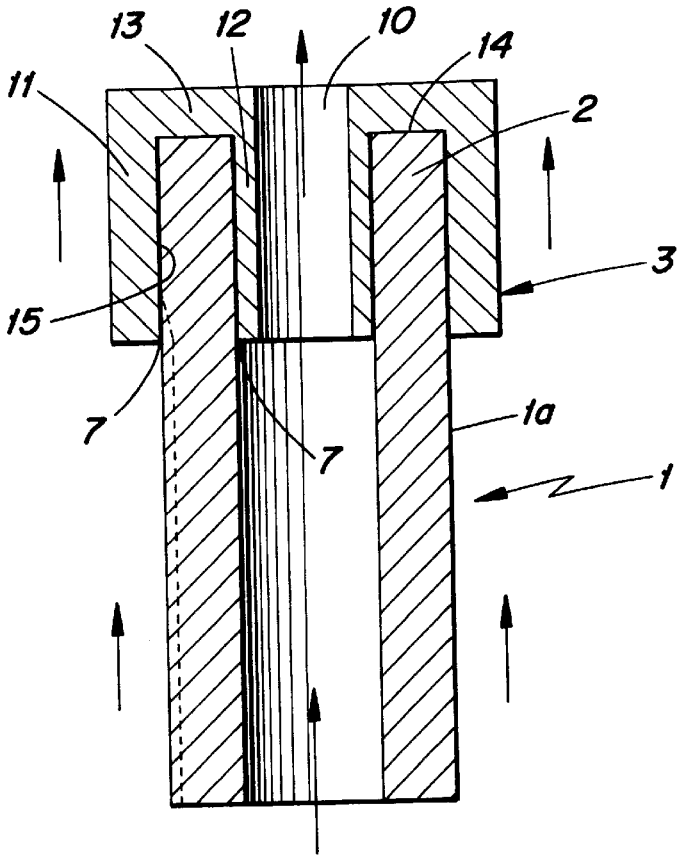
FIG. 3 is a longitudinal sectional view through a drill member on which is mounted a heat treatment lid according to the present invention.
Figure 3A:
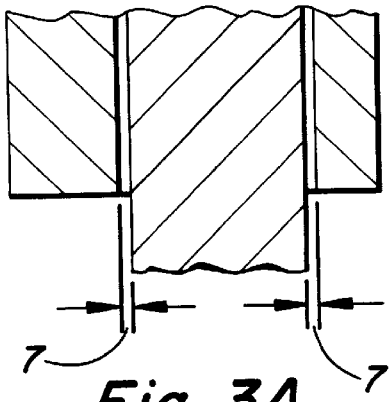
FIG. 3A is an enlargement of a fragment of FIG. 3.
Figure 3B:
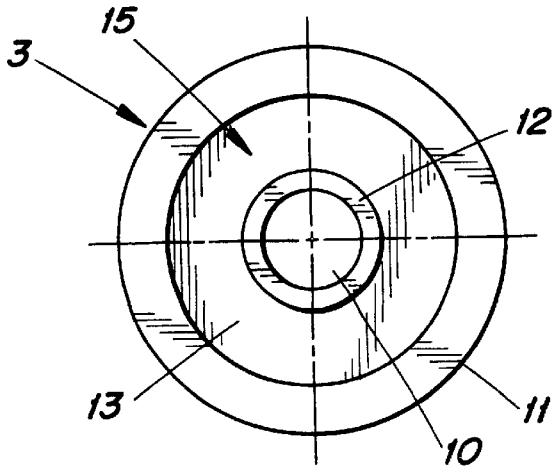
FIG. 3B is a bottom view of the heat treatment lid of FIG. 3.

FIG. 3 shows a device in the form of a lid 3, formed for example of ceramics or steel, for counteracting the thermo chemical effect of a steel surface 14. The steel surface is preferably provided on the end 2 of a hollow tube or a rod 1 to be used for percussive drilling. The device has a tubular outer side wall or external lid part 11 and a tubular internal side wall or inner lid part 12. The inner and external side walls 12, 11 are symmetrical about a longitudinal axis of the tube 1 and are interconnected by a ring-shaped end wall portion 13 at one end surface such that a circular ring-shaped recess 15 is formed for receiving the tube end 2. The internal diameter of the outer wall 11 and the outer diameter of the internal wall 12 shall be dimensioned such that an outer gap 7 is formed between the tube 1 and the outer wall 11 of the lid, and an inner gap 7 is formed between the tube 1 and the inner wall 12 of the lid (see FIGS. 3, 3A). Each gap 7 is equal to or less than 0.1 mm. The lid is disposed on the tube end 2 during the heat-treatment. Arrows depict the motion of the furnace atmosphere about the surfaces.

Figure 4:
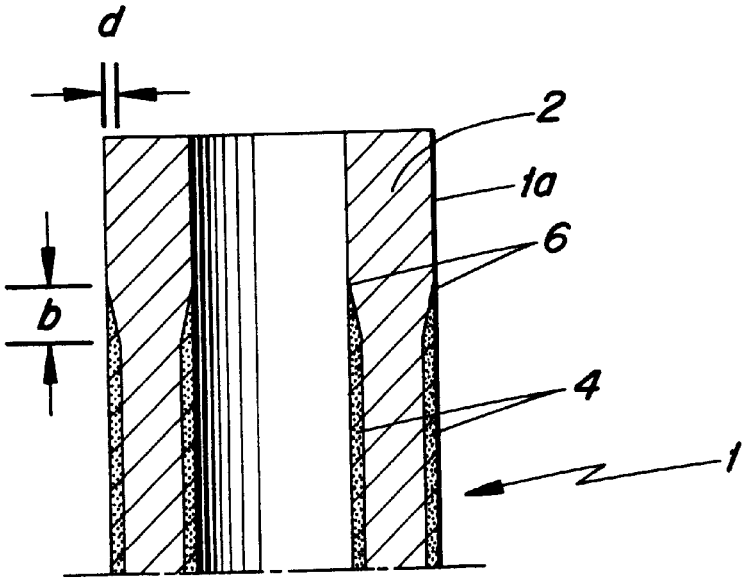
FIG. 4 is a longitudinal sectional view through the heat treated drill member of FIG. 3.

FIG. 4 shows an example of a carburized tube 1 the end 2 of which has been protected against carburizing (externally and internally) by the aid of the lid 3 according to the present invention. The lid covered both the end surface 14 and part of the envelope surface 1*a* of the tube. The carburized layer has an elongated and continuous transition zone 6 between the carburized layer and the untreated surface. The transition zone length is depicted by the letter b. The transition zone length b of the thermo chemically treated surface is longer than the transition zone length which is obtained by other protective methods such as dipping, painting, etc. Preferably, the ratio b/d is greater than 1, and most preferably, is more than double the ratio a/d resulting from the conventional masking technique. The external lid wall 11 and the internal lid wall 12 have equal lengths and thereby create equally long protected areas at the inside and outside surfaces, respectively, of the tube 1. By the expression "non-carburized" and similar expressions, is here meant that a "non-carburized" surface may have a negligible increase of carbon, which does not appreciably influence the result of the heat treatment.

Figure 5:
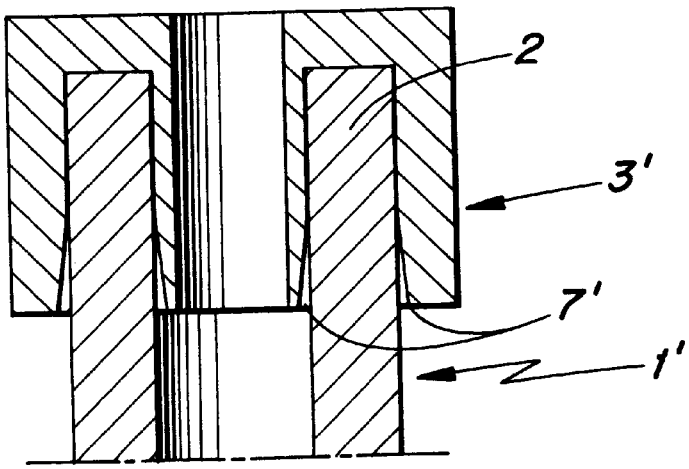
FIG. 5 is a view, similar to FIG. 3, of a second embodiment of the invention.
Figure 6:
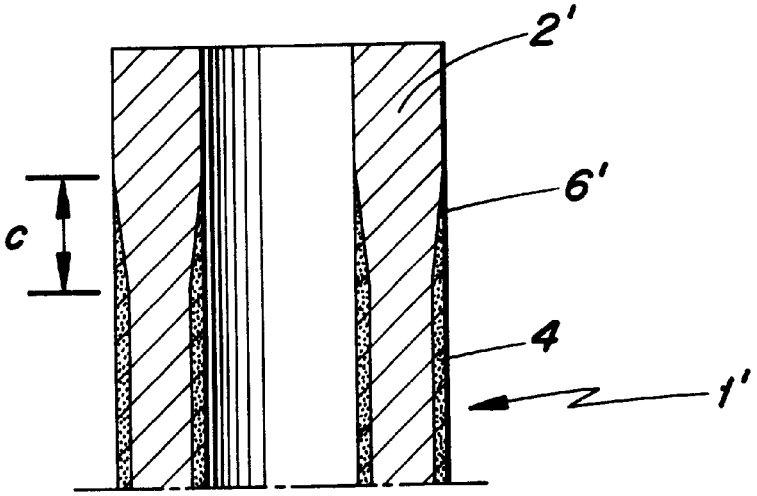
FIG. 6 is a longitudinal sectional view of a drill member heat treated in accordance with FIG. 5.

FIG. 5 shows an alternative embodiment of a device or lid 3' according to the present invention. The device 3' has cambered exits 7' both externally and internally, wherein the transition between the carburized layer 4' of the carburized part of the tube 1' and the non-carburized surface of the tube end 2' becomes longer than in the example of FIG. 3. This is shown in FIG. 6 where the transition zone length is depicted by the letter c. The length of the transition zone can be adjusted by more or less chamfering of the internal diameter of the external lid part and likewise chamfering of the outer diameter of the internal wall of the device 3'.

A comparison of the three different variants described above shows the following relationship of the transition zone lengths for the carburized layers: a<b<c.

The protective lid 3 is developed to fit onto a hollow symmetrical tube end or rod end. The object is that the lid shall have sufficient fit such that the furnace atmosphere will not enter too far along the part of the tube wall which is protected against thermo chemical treatment such as for example carburizing. Normally, it is sufficient to have a gap 7 equal to or less than 0.1 mm if there simultaneously is abutment between the end surface 14 of the tube end and the bottom 13 of the lid.

By chamfering the lid, such as is shown in FIG. 5, with chamfers 7' the gap opening is increased. Thereby the transition zone 6' for the carburizing layer can be made even longer i.e., with a length c, than with the gap 7 of constant width. In this manner favorable tensions in the transition zone are obtained for example when the tube or rod is submitted to bending stresses.

Alternatively the external lid wall 11 and the internal lid wall 12 could have different lengths and thereby provide differently extended protected areas at the internal and external surfaces of the tube 1. Likewise the internal diameter of the hole 10 extending through the inner lid wall can be reduced such that the thermo chemical effect at the inside of the tube becomes less than at the tube surface.

The lid must be made of a material which does not influence the composition in the tube surface. Preferably a ceramic material or a steel is used having a composition which is balanced with respect to the steel in the tube.

The lid is placed either on top of the standing tube end such that the lid falls down by its own weight against the tube end surface 14, or the tube can be controllably lowered onto the lid. The hole 10 extending through the lid enables the thermo chemical treatment to also be obtained at the inside of the tube on the surface which internally is not protected by the lid. By making a smaller hole in the lid, the carburizing depth inside on the unprotected surfaces can be made less than at the external unprotected surfaces.

Figure 7:
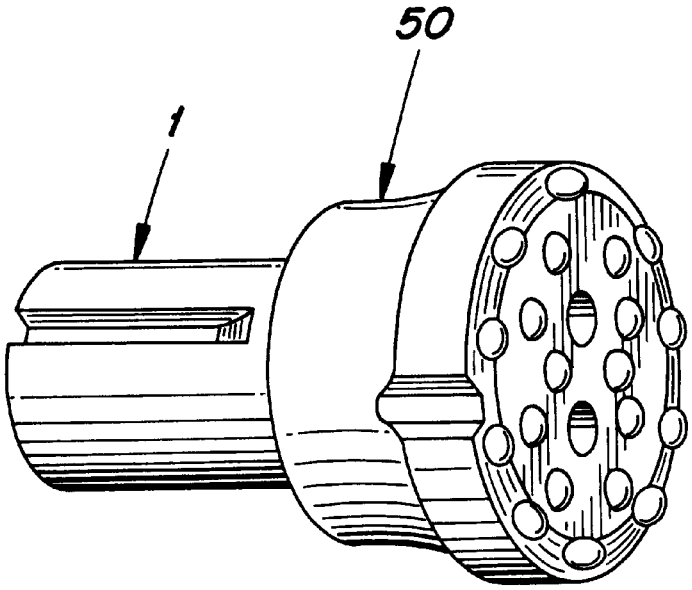
Fig. 7 (PRIOR ART)
FIG. 7 is a perspective view of a conventional drill member attached to a cutting head.

The method relates to applying a lid on the part of the tube which is not to be thermo chemically treated. The method for masking a drill member during a thermo chemical surface treatment, such as carburizing or nitriding, comprises the following steps: providing a drill member such as a drill tube or a drill rod, said member having a substantially elongated basic shape and at least one free end and a central channel for flush medium, providing a lid which is substantially geometrically adapted to the free end of the member, bringing the lid and the free end of the member into abutment against each other, placing the lid and the member in a furnace having a suitable furnace atmosphere and a suitable temperature for heat-treatment of metal, allowing the furnace atmosphere to partly enter between the lid and the member such that the heat-treatment is successively reduced in direction towards the free end surface and such that the transition zone becomes elongated, and cooling the lid and the member to ambient temperature and removing the lid from the member. As a result, the drill member is adapted to be connected to a cutting head 50 (see FIG. 7) by welding, screw threads, etc.

There are several advantages with this method, such as quick applying and removal of the protection, good reproducability of the protective effect, possibility to vary the transition between the thermo chemically treated surface and the untreated surface, the possibility to vary the thermo chemical treatment at the inside of the tube, and the possibility to control the length and the appearance of the transition.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method of performing a thermo chemical surface treatment on a metallic percussive drill member, the drill member being of elongated shape and having a central channel formed therein, the method comprising the steps of:

A) positioning on an end portion of the drill member a lid such that an end wall of the lid abuts a free end of the drill member, and a side wall of the lid extends along a surface of the drill member, the side wall facing the surface and chosen to be spaced from the surface by a selected amount, whereby a gap is formed therebetween;

B) heating the lid and the drill member to a heat-treating temperature in a furnace whereby a portion of the surface of the drill member not covered by the lid is heat-treated to a depth, and whereby furnace atmosphere enters the gap and causes the heat treatment depth to be gradually reduced in a direction toward the end wall;

C) cooling the lid and the drill member; and

D) removing the lid from the drill member.

2. The method according to claim 1 wherein the heat treatment produced during step B comprises carburizing.

3. The method according to claim 1 wherein the heat treatment produced during step B comprises nitriding.

4. The method according to claim 1 wherein step A includes forming the gap such that a depth of the gap gradually decreases in a direction toward the end wall.

5. The method according to claim 1 wherein the side wall of the lid comprises an outer side wall, the lid further comprising an inner side wall spaced inwardly from the outer side wall; step A comprising positioning the lid such that the inner side wall enters the central channel of the drill member and forms another gap with a surface of the central channel.

* * * * *